United States Patent [19]

Bruney et al.

[11] Patent Number: 4,567,607

[45] Date of Patent: Jan. 28, 1986

[54] STEREO IMAGE RECOVERY

[75] Inventors: Paul F. Bruney, Silver Spring; Robert S. Bugash, Wheaton, both of Md.

[73] Assignee: Stereo Concepts, Inc., Washington, D.C.

[21] Appl. No.: 554,385

[22] Filed: Nov. 22, 1983

Related U.S. Application Data

[63] Continuation-in-part of Ser. No. 491,297, May 3, 1983, Pat. No. 4,495,637, which is a continuation-in-part of Ser. No. 401,211, Jul. 23, 1982, abandoned.

[51] Int. Cl.[4] ..... H04R 5/00

[52] U.S. Cl. ..... 381/1; 381/97; 381/99; 381/100

[58] Field of Search ..... 381/1, 17, 97, 98, 99, 381/100, 103, 18, 19

[56] References Cited

U.S. PATENT DOCUMENTS

| | | | |
|---|---|---|---|
| 3,170,991 | 2/1965 | Glasgal | 381/1 |
| 3,246,081 | 4/1966 | Edwards . | |
| 3,725,586 | 4/1973 | Iida . | |
| 3,883,692 | 5/1975 | Tsurushima . | |
| 3,911,220 | 10/1975 | Tsurushima . | |
| 3,916,104 | 10/1975 | Anazawa et al. . | |
| 3,925,615 | 12/1975 | Nakano . | |
| 4,027,101 | 5/1977 | DeFreitas et al. . | |
| 4,087,629 | 5/1978 | Atoji et al. . | |
| 4,087,631 | 5/1978 | Yamada et al. . | |
| 4,097,689 | 6/1978 | Yamada et al. . | |
| 4,121,059 | 10/1978 | Nakabayashi | 381/1 X |
| 4,139,728 | 2/1979 | Haramoto et al. | 381/1 |
| 4,149,036 | 4/1979 | Okamoto et al. . | |
| 4,192,969 | 3/1980 | Iwahara . | |
| 4,209,665 | 6/1980 | Iwahara . | |
| 4,218,585 | 8/1980 | Carver . | |
| 4,219,696 | 8/1980 | Kogure et al. . | |
| 4,303,800 | 12/1981 | DeFreitas . | |
| 4,309,570 | 1/1982 | Carver . | |

FOREIGN PATENT DOCUMENTS

| | | | |
|---|---|---|---|
| 111400 | 9/1981 | Japan | 381/1 |

OTHER PUBLICATIONS

Kinsler & Frey, "Fundamentals of Acoustics", John Wiley & Sons, Inc., N.Y., 1950, pp. 370–392.

Zwislocki and Feldman, "Just Noticeable Differences in Dichotic Phase", J. Acoust. Soc. Amer., 28, p. 860, 1956.

Sivian and White, "On Minimum Audible Sound Fields", J. Acoust. Soc. Amer., 1933, 4, pp. 288–321.

Fletcher and Munson, "Loudness, Its Definition, Measurement and Calculation", J. Acoust. Soc. Amer., 1933, 5, pp. 82–108 and others.

Shaw, "National Research Council", Ottawa, Canada, Audio, Phil., Pa., 1978, 5, pp. 92–93.

Wireless World, vol. 88, No. 1562, Nov. 1982, Great Britain; S. H. Buijs "Binaural Recordings and Loudspeakers", pp. 39–41, 64.

Patent Abstracts of Japan, vol. 8, No. 125, Jun. 22, 1984, p. (E-252) (1572); & JP-A-59-44200 (Matsushita Denki Sangyo) 12-03-84.

*Primary Examiner*—Forester W. Isen

*Attorney, Agent, or Firm*—Cushman, Darby & Cushman

[57] ABSTRACT

A method and apparatus for improving the accuracy in locating psychoacoustic images in plural channels of related audio signals. Signals are cross-fed from one channel to another in an out-of-phase relationship with respect to the signals in the other channel. The phase relationship is such that it has not more than a single maximum with respect to frequency. Cross-feeding is limited to frequency components less than a predetermined value in the range of 1,000 to 5,000 Hertz. The overall gain of each of the audio channels in the frequency range of approximately 100 to 1,000 Hertz is greater when a signal is applied to that channel only, than when the signal is applied to both channels. When the same signal is applied to both channels, a dip in gain occurs for frequencies in the range of approximately 200 to 900 Hertz. Above the dip, the gain is relatively flat and below the dip, the gain increases gradually.

43 Claims, 2 Drawing Figures

STEREO IMAGE RECOVERY

This is a continuation-in-part of application Ser. No. 491,297 filed May 3, 1983, now U.S. Pat. No. 4,495,637 which is, in turn, a continuation-in-part of application Ser. No. 401,211 filed July 23, 1982, now abandoned. The contents of said applications are incorporated herein by reference.

BACKGROUND OF THE INVENTION

1. Field of the Invention

This invention is generally directed to apparatus and method for processing plural channels of related audio signals such as stereophonic, quadraphonic, et cetera. In particular, this invention is directed to apparatus and method for providing more accurately located psychoacoustic images when related (e.g., prerecorded) signals in such plural channels as simultaneously processed and transferred to plural corresponding acoustic signal sources by respectively corresponding electroacoustic transducers.

2. Description of the Prior Art

The general problem of faithfully recording (or transmitting) a naturally occurring field of acoustic signals and of faithfully reproducing an identically perceived field of such acoustic signals in another location is quite old in the art. There are a multitude of various stereophonic, quadraphonic and other sound reproduction systems which attempt with varying degrees of success to achieve such a desired result. However, as the continued proliferation of new and/or alternate sound reproduction systems continues, it is apparent that no perfect solution has yet been achieved.

In most simple two speaker versions of prior art reproduction systems, psychoacoustic image enhancement is usually accomplished in an attempt to place the outermost reproduced acoustic images beyond the actual physical locations of the left and right speakers. To achieve this enhancement, such circuits typically use either phase shift or phase inversion, variation in gain or combinations of both sometimes in concert with frequency tailoring, time delay, and/or compression or expansion. Some examples of these prior art image enhancement circuits may be seen by examining the following U.S. patents:

| | | |
|---|---|---|
| U.S. Pat. No. 3,246,081 | Edwards | (1966) |
| U.S. Pat. No. 3,725,586 | Iida | (1973) |
| U.S. Pat. No. 3,883,692 | Tsurushima | (1975) |
| U.S. Pat. No. 3,911,220 | Tsurushima | (1975) |
| U.S. Pat. No. 3,916,104 | Anazawa et al | (1975) |
| U.S. Pat. No. 3,925,615 | Nakano | (1975) |
| U.S. Pat. No. 4,027,101 | DeFreitas et al | (1977) |
| U.S. Pat. No. 4,087,629 | Atoji et al | (1978) |
| U.S. Pat. No. 4,087,631 | Yamada et al | (1978) |
| U.S. Pat. No. 4,097,689 | Yamada et al | (1978) |
| U.S. Pat. No. 4,149,036 | Okamoto et al | (1979) |
| U.S. Pat. No. 4,192,969 | Iwahara | (1980) |
| U.S. Pat. No. 4,209,665 | Iwahara | (1980) |
| U.S. Pat. No. 2,218,585 | Carver | (1980) |
| U.S. Pat. No. 4,219,696 | Kogure et al | (1980) |
| U.S. Pat. No. 4,303,800 | DeFreitas | (1981) |
| U.S. Pat. No. 4,309,570 | Carver | (1982) |

With phase shifting or phase inversion, the stereo signal typically consists of a predominating channel signal appearing on one loudspeaker while the same signal appears in the opposite speaker but lower in amplitude and out-of-phase. Such circuits tend to create a "hole-in-the-middle" effect when the speaker is situated between the stereo speakers. That is, as the sound appears to come from further to the side of a listener, the sound tends to disappear from directly in front of the listener leaving a hole.

All prior art commercial systems have been criticized for creating poorly defined psychoacoustic images, weak center stage acoustic images (i.e., the "hole-in-the-middle" effect) or, especially in cases where expansion or compression functions are used, pyschoacoustic images which do not remain stationary. Furthermore, these commercial systems which provide cross-feeding do so over a broad range of frequencies.

A great deal of research has been performed with respect to the human hearing system and described in papers. For example, the acoustic intensity that can be barely heard at any particular frequency is known as the threshold of hearing or the threshold of audibility for that frequency. Threshold determinations fall roughly into two classes: "minimum audible field" (M.A.F.) and the "minimum audible pressure" (M.A.P.). The former is in terms of the intensity of the sound field in which the observer's head is placed; the latter, in terms of the pressure amplitude at the observer's eardrum.

The M.A.F. values directly relate to the usual mode of hearing, i.e., with the unaided ear. They are the more applicable when extended to include the effects of binaural hearing and of the listener's orientation with respect to the sound field. Such M.A.F. curves have been determined by Sivian and White, "On Minimum Audible Sound Fields", J. Acoust. Soc. Amer., 1933, 4, p. 288–321; Fletcher and Munson, "Loudness, Its Definition, Measurement and Calculation", J. Acoust. Soc. Amer., 1933, 5, p. 82–108, and others. The work of these researchers reveals that a pure tone having a given intensity level may be audible at some frequency levels but not audible at other frequency levels. Thus, the loudness of such a tone, as perceived by a listener, is therefore a function of not only its intensity but also its frequency.

Fletcher and Munson realized that the shape of these curves is determined, in part, by the direction around the head of the observer as he faces the source of sound. The external ear, or pinna, and the head have an effect on the sound. The head acts as a baffle and refractive object, and the cavities of the pinna have resonances which can be excited. Shaw, "National Research Council", Ottawa, Canada, Audio, Philadelphia, Pa., 1978, 5, p. 92–93 measured curves which show the effects of the external ear on the sound pressure at the eardrum compared with the free field when the sound source is placed at varying angles with respect to the ear.

The ability to localize the direction and to form some judgement of the distance from a sound source under ordinary conditions are matters of common experience. Two primary factors are employed to determine the horizontal arrival direction of a sound: (1) its relative intensity in the two ears of an observer and (2) its relative time of arrival at the two ears, or, for a sustained tone, the difference in phase between the waves arriving at the right and left ears. (See Kinsler and Frey "Fundamentals of Acoustics", John Wiley & Sons, Inc., N.Y. 1950, p. 370–392.) Thus, minimum audible field curves for binaural hearing were measured by Sivian and White, showing how the M.A.F. varies with the observer's azimuth relative to the wavefront.

With pure tones above 1400 Hertz, the ears cannot detect phase or time differences. See Zwislocki and Feldman, "Just Noticeable Differences in Dichotic Phase" J. Acoust. Soc. Amer., 28, p. 860, 1956. It has been found that it is only the intensity difference which furnishes a clue to directional hearing for these frequencies. The same intensity difference may arise at different azimuths at some frequencies, meaning that the intensity difference offers no exact clue to directional hearing.

With respect to depth localization, the Fletcher and Munson curves show that higher frequencies become more audible at greater intensity levels. Therefore, in the matter of distance between a sound source and an observer, a greater intensity level corresponds to a reduced proximity to the sound source. As a result of the relative increase in higher frequencies due to the Fletcher/Munson effect, the higher level also corresponds to an increased interaural sense, provided the sound intensity is equal in both ears. Thus, the Fletcher/Munson effect might be used to change the perceived distance of the sound, or to maintain the apparent distance of a sound which changes in intensity. See U.S. Pat. No. 4,204,092 to Bruney. Distance perception changes coincide with the changes in the lower and higher frequency ranges.

Despite this research that has been performed with respect to the human hearing system, no attempt has been made to apply findings for enhancing psychoacoustic imaging. Thus, the above-listed Carver patents teach the use of equalizers in the channels of a stereo circuit which have gains which resemble the Fletcher/-Munson threshold curves. However, the gains have not been modified to account for the effect of the outer ear. Furthermore, the effect is applied to all signals independent of the degree of separation.

SUMMARY OF THE INVENTION

The present invention represents a novel and creative application of the principles set forth above to improve the accuracy in locating psychoacoustic images in plural channels of related audio signals. In the present invention, signals are cross-fed from one channel to another in an out-of-phase relationship with respect to the signals in the other channel. The phase relationship is such that the phase difference between the cross-fed signals and the "in channel" signals has not more than a single maximum with respect to frequency, which significantly reduces distortion. Distortion is also reduced by limiting cross-feeding to frequency components less than a predetermined value in the range of 1,000 to 5,000 Hertz.

To enhance the separation of sounds which should be perceived to the sides of a listener, the overall gain of each of the audio channels in the frequency range of approximately 100 to 1,000 Hertz is greater when a signal is applied to that audio channel only, than when the signal is applied to both channels. At the same time, to preserve the subjective distances accurately, the required center volume level reduction must not increase the perceived relative distance between the observer and centrally located (monaural) apparent sound sources. Therefore, equalization according to the Fletcher/Munson effect, with the effects of the outer ear removed, is applied to monaural sounds. The primary characteristic of the modified Fletcher/Munson effect is a dip in gain for frequencies in the range of approximately 200 to 900 Hertz. Secondary characteristics of the modified Fletcher/Munson effect are a relatively flat gain above the dip and a gradually increasing gain below the dip.

An advantage of the dip, in addition to producing the Fletcher/Munson effect is to compensate for localization cues created by the static positions of the two playback loudspeakers. Typically, loudspeakers are placed at 45° with respect to an observer. The dip referred to above enhances the feeling that a monaural sound from both speakers is produced by a source directly in front of the observer.

Below approximately 1,400 Hertz, a boost in gain is necessary to compensate for acoustic cancellation of out-of-phase signals. It has been determined that low frequency signals from most sources are recorded essentially monaurally. When such monaural signals pass through an out-of-phase cross-feeding network, not only will the low frequency signals not be boosted, but instead will be cancelled. The present invention corrects for this by inverting the phase of low frequency signals in one channel by as much as 180° with respect to higher frequency signals. Then, when low frequency signals pass through an out-of-phase cross-feeding network, the low frequency signals add, instead of cancel, thus enhancing the low frequency response.

To prevent acoustic cancellation, after cross-feeding, the low frequency signals in one of the channels are reversed with respect to the high frequency signals. Advantageously, one phase reversing circuit is disposed in each channel to help balance the propagation delays through each channel. Despite this balancing, the phase reversing circuit before the cross-feeding does delay the signal to the cross-feed network as compared to the other channel. Therefore, during cross-feeding, some cancellation does occur. A compensation circuit may be employed in one of the channels to compensate for the decrease in gain caused by out-of-phase cancellation.

For a signal applied to only one channel of the present invention, the gain in that channel remains relatively constant at frequencies above 5,000 Hertz at a value less than the gain at frequencies below 1,400 Hertz. This boost also helps compensate for acoustic cancellation.

That a circuit can be realized which achieves the rather complex transfer function defined above is surprising enough. However, the preferred embodiment of the present invention generates the transfer function employing only four operational amplifiers and associated passive elements. Two amplifiers are employed to perform cross-feeding and two amplifiers are employed to perform the phase reversal.

Even more remarkable is the fact that the preferred embodiment of the present invention responds independently to sources. Thus, if a very directional source is superimposed on a primarily monaural signal, the present invention will locate the directional source accurately. Thus, the present invention does not monitor for the overall degree of separation and control the amount of separation provided by the circuit in response thereto.

BRIEF DESCRIPTION OF THE DRAWING

These and other objects and advantages of this invention will become better appreciated and more readily understood from the following detailed description of the presently preferred exemplary embodiment of this invention, taken in conjunction with the accompanying drawing, of which.

DETAILED DESCRIPTION OF PRESENTLY PREFERRED EXEMPLARY EMBODIMENT

Figure 1:
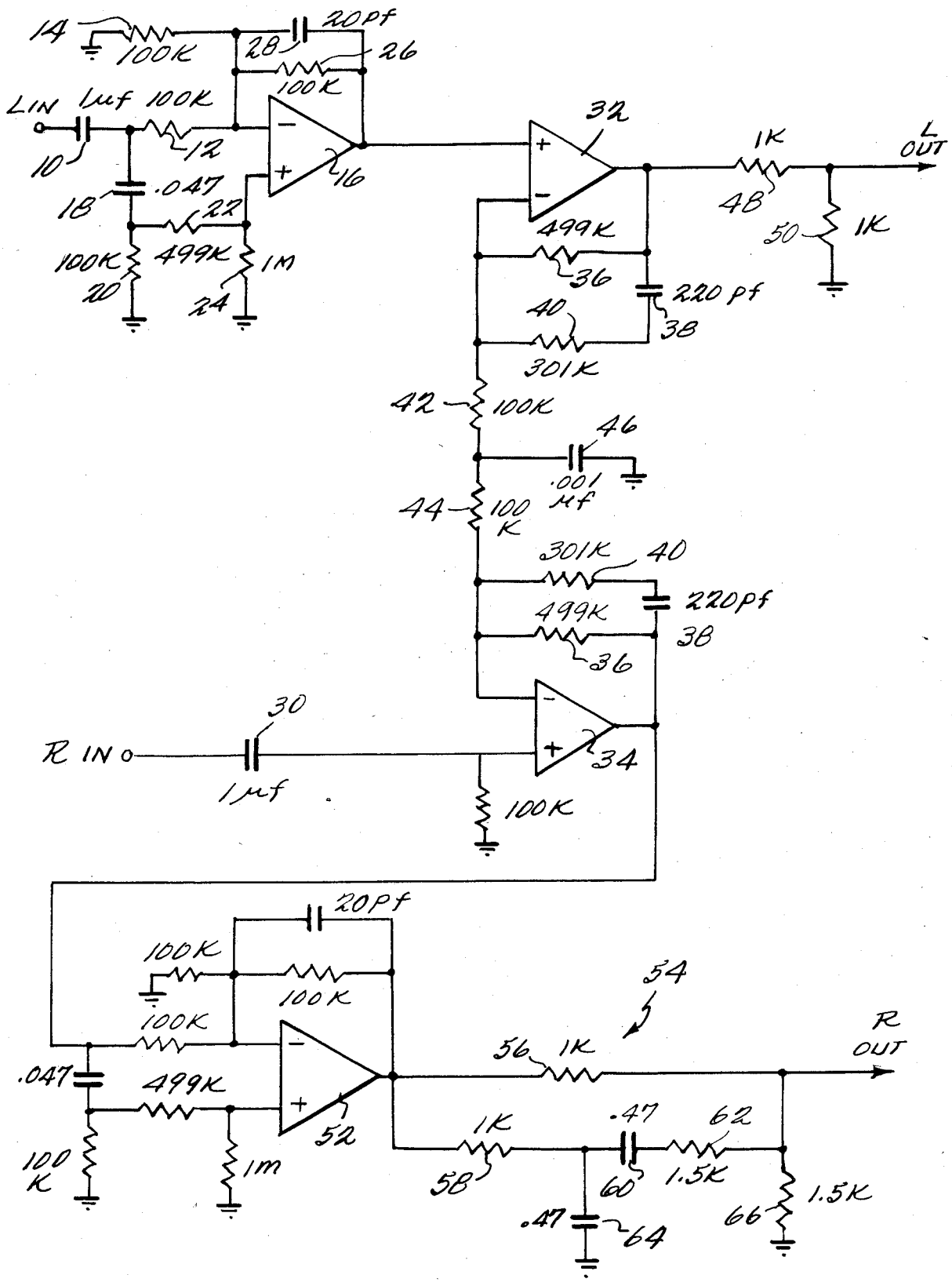
FIG. 1 is a detailed electrical schematic diagram of one specific exemplary embodiment of the present invention.

In FIG. 1, signals in the left channel pass through coupling capacitor 10 and input resistors 12 and 14. The junction between resistors 12 and 14 is connected to the inverting input of operational amplifier 16. The left channel signal through capacitor 10 also is applied to capacitor 18 which has a terminal connected to ground through resistor 20. The junction between capacitor 18 and resistor 20 is connected to the noninverting input of amplifier 16 through resistor 22. The noninverting input of amplifier 16 is connected to ground through resistor 24. Feedback resistor 26 is connected between the output and the inverting input of amplifier 16. Capacitor 28 is connected in parallel with resistor 26 for stabilization.

The purpose of amplifier 16 and associated elements is to reverse the phase of low frequency components as compared to high frequency components. Thus, for very low frequency components, capacitor 18 appears to be open. Therefore, the gain of amplifier 16 is negative one. At very high frequencies, capacitor 18 appears as a short so that the gain of amplifier 16 is positive one. Therefore, the phase of low frequency signals are shifted 180° with respect to the phase of high frequency signals while maintaining the gain constant. The frequency range over which the change-over occurs is controlled by capacitor 18 and resistor 20. In the preferred embodiment, the time constant of this circuit, i.e., the inverse of the product of the values of resistor 20 and capacitor 18 is approximately 200 Hertz and can be in the range from 100 to 400 Hertz.

The left channel signal from amplifier 16 and the right channel signal through coupling capacitor 30 are applied to channel amplifiers 32 and 34, respectively. Each of amplifiers 32 and 34 has a resistor 36 connected between its output and inverting input. Capacitor 38 and resistor 40 are connected in series with each other and in parallel with resistor 36. A cross-feed network is connected between inverting inputs of amplifiers 32 and 34. The cross-fed network includes series connected resistors 42 and 44 and capacitor 46. Resistors 36, 40, 42 and 44, and capacitors 38 and 46 are selected so that when a signal is applied only to the left channel, the gain of amplifier 32 is relatively flat from 5,000 Hertz to 20,000 Hertz. At approximately 1,400 Hertz, the gain of amplifier 32 rises to a higher level.

Figure 2:
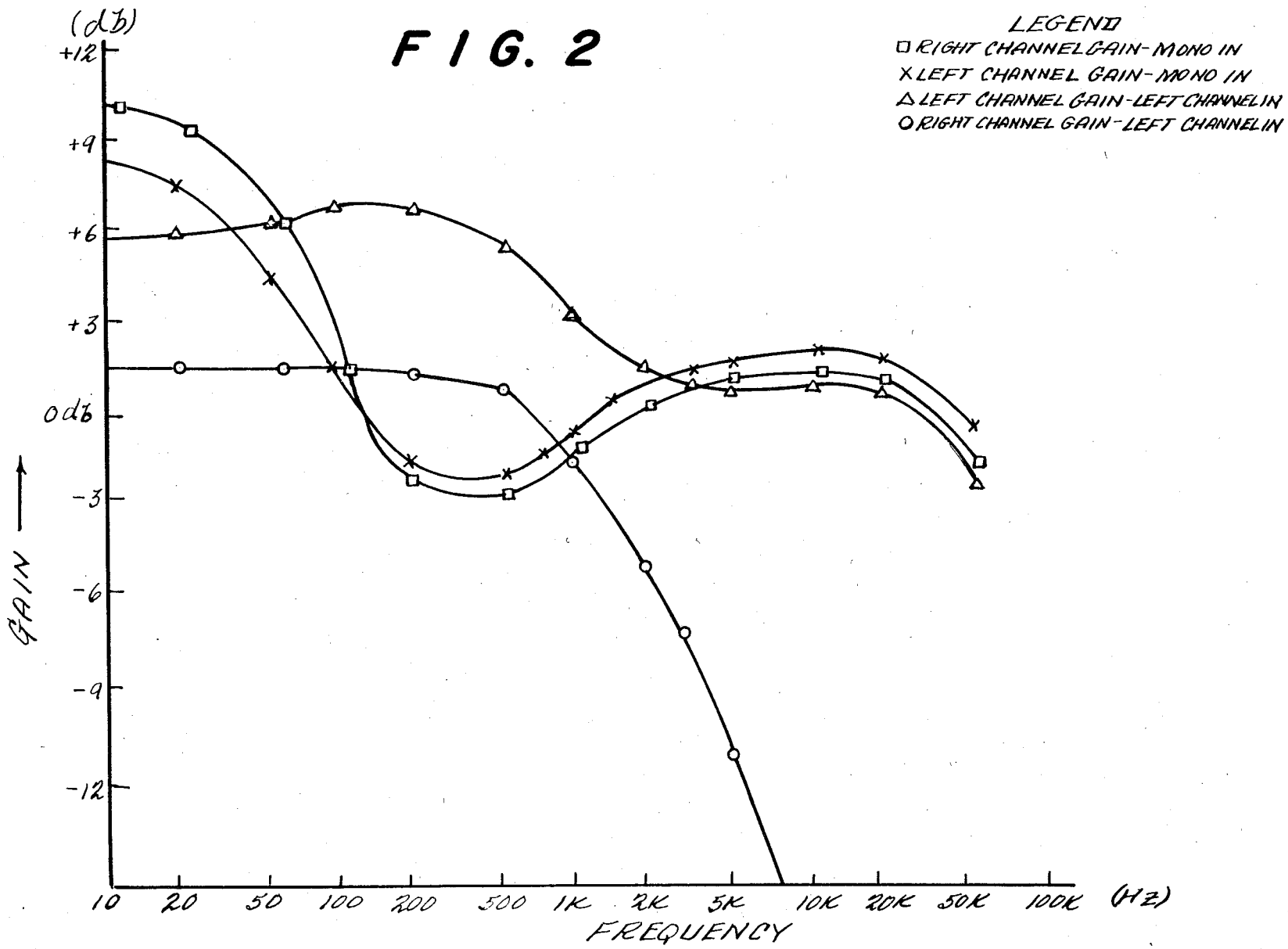
FIG. 2 is the transfer function of the circuit of FIG. 1.

As a result of resistors 42 and 44 and capacitor 46, a signal applied to the left channel also produces an output from amplifier 34. Thus, as illustrated in FIG. 2, for lower frequencies, the gain of amplifier 34 is approximately 3 db less than the gain of amplifier 32 for signals applied to the left channel. However, in the range of 1,000 to 5,000 Hertz, the cross-feeding drastically decreases.

Capacitor 46 and resistors 42 and 44 control the amount of cross-feeding. High frequency signals are shorted through capacitor 46 while capacitor 46 appears open to low frequency signals, so that cross-feeding is at a maximum. As frequency decreases, the impedances of capacitors 38 and 46 increase. The increase in impedance of capacitor 38 causes the feedback impedance across amplifier 32 to increase. However, the input impedance, controlled by resistors 42 and 44 and capacitor 46 also increases so that the gain of amplifier 32 remains relatively constant in the range of 5,000 to 20,000 Hertz. This gain remains constant despite the fact that cross-feeding begins to occur in at least the lower portion of this range.

These frequency dependent responses as described above are controlled by the values of resistors 40, 42 and 44 and capacitors 38 and 46. In the present invention, the time constant of capacitor 38 and resistor 40, i.e., the inverse of the product of the values of capacitor 38 and resistor 40 should be in the range of 14,000 to 20,000 Hertz. The time constant of capacitor 46 and resistors 42 and 44, i.e., the inverse of the product of the value of capacitor 46 and the value of resistors 42 and 44 connected in parallel, should be in the range of 15,000 to 25,000 Hertz.

When the same signal is applied to both channels, the gain of amplifiers 32 and 34 will remain relatively flat above 5,000 Hertz since cross-feeding does not occur. However, as illustrated in FIG. 2, as cross-feeding occurs, the signals from opposite channels will combine in an out-of-phase relationship to a greater extent, thus cancelling signals. This produces a dip in the range of 200 to 900 Hertz. At a sufficiently low frequency, amplifier 16 causes the phase of low frequency signals to be reversed, so that the cross-feeding actually increases the gain of the resulting signal. This produces the rise on the low frequency side of the dip in FIG. 2.

The output of amplifier 32 is applied to a voltage divider consisting of resistors 48 and 50. The output of amplifier 34 is applied to a network surrounding amplifier 52 which is identical to the network surrounding amplifier 16. It will be recalled that amplifier 16 reverses the phase of low frequency signals with respect to high frequency signals in the left channel. If the signals from amplifiers 32 and 34 were simply introduced into a room through loudspeakers, the phase of the low frequency signals in the left channel would be inverted with respect to the phase of the low frequency signals in the right channel. Therefore, the signals would acoustically cancel in the room. Amplifier 52 and related circuitry is provided to reverse the low frequency signals in one of the channels after cross-feeding so as to reduce the possibility of acoustic cancellation.

Despite the fact that amplifier 52 is in the right channel while amplifier 16 is in the left channel, and despite the fact that amplifiers 32 and 34 and the cross-feeding network therebetween are perfectly symmetrical, the circuit as a whole is not quite symmetrical. That is, amplifier 16 introduces a delay prior to cross-feeding which does not occur in the right channel. When stereo signals are applied to the circuit with good separation, this causes the left channel signal to seem louder. This is particularly noticeable in the middle frequencies.

To compensate for this apparent difference in loudness, network 54 is provided at the output of amplifier 52. Network 54 consists of resistor 56 connected in parallel with the series combination of resistor 58, capacitor 60 and resistor 62. Capacitor 64 has one terminal connected between resistor 58 and capacitor 60 and another terminal connected to ground. Resistor 66 is provided between the interconnection of resistors 56 and 62 and ground. The gain of network 54 at middle frequencies, around 500 Hertz, approaches unity whereas the gain at high and low frequencies is less than unity. Obviously, instead of employing network 54 in the right channel, a network with an inverse transfer function could be placed in the left channel.

Amplifier 52 and the network therearound could be placed in the left channel instead of the right channel to bring the phase of the low frequency signals in the left channel back in approximate correspondence with the phase of low frequency signals in the right channel. However, the phase difference would exist in that the left channel signals would pass through two phase reversal circuits whereas the signals in the right channel would pass through no phase reversal circuits. Therefore, it is preferable to place one phase reversal circuit in one channel and the other phase reversal circuit in the other channel.

The transfer function of the circuit in FIG. 1 is illustrated in FIG. 2. One set of curves represents the gain of the circuit of FIG. 1 when the same signal is applied to both the right and left channels, and the other curves represent the gain when a signal is applied only to the left channel.

Note that in the range of 100 to 1,000 Hertz, the gain of the circuit when the same signal is applied to both channels is less than the gain of one channel when a signal is applied only to that channel. This, in combination with the out-of-phase cross-feeding, enhances the imaging of sources on the extreme sides of an observer.

This would tend to produce a hole-in-the-middle effect if steps were not taken to compensate. Accordingly, the gain of the circuit when the same signal is applied to both channels assumes the approximate shape of a modified Fletcher/Munson curve. That is, a dip in gain occurs in the range of 200 to 900 Hertz. At frequencies above the dip, the gain is fairly constant. Below the dip, gain increases gradually.

When the same signal is applied to both channels, at high frequencies, no cross-feeding occurs. As the frequency decreases from 5,000 Hertz to 20,000 Hertz, capacitors 38 and 46 cause the feedback impedance of amplifiers 32 and 34 increases. However, at the same time, the input impedance of amplifiers 32 and 34 also increases, so that the gain remains relatively constant, producing the flat portion of the monaural curve between 20,000 and 5,000 Hertz. However, during this range, cross-feeding increases and the phase of the cross-fed signals with respect to the "in channel" signals increases. Below 5,000 Hertz, the phase difference increases so as to approach 180°. This causes cancellation between the cross-fed signals and the "in channel" signals, producing the higher frequency side of the dip.

Around 500 Hertz, however, amplifier 16 begins changing the phase of low frequency signals with respect to high frequency signals. When the frequency components with changed phase are cross-fed, the cross-fed signals add with the "in channel" components producing an increased gain. This effect results in the lower frequency side of the dip and the increasing gain at frequencies below the dip.

Thus, in the embodiment of FIG. 1, the phase difference between the cross-fed signals and the "in channel" signals has a single maximum in the range of 200 to 900 Hertz. In the preferred embodiment, the maximum is at about 500 Hertz. When frequencies change in either direction away from the range of 200 and 900 Hertz, the phase difference between the cross-fed signals and the in channel signals decreases. The decrease in phase difference toward higher frequencies is caused by the reduced effect of capacitor 46 and the cross-feeding network. The decrease in phase difference toward lower frequencies results from the phase reversal effects of amplifier 16 and associated circuitry.

Thus, the maximum phase difference corresponds with the bottom of the dip. In the range of 200 to 900 Hertz, the phase difference approaches 180°. This phase difference decreases as frequency moves from the range of 200 to 900 Hertz. Thus, the phase difference has a single maximum. By limiting the phase relationship to such a simple function with a single maximum and by limiting cross-feeding to below a predetermined range of frequencies, distortion in the present invention is minimized.

When a signal is applied to the left channel only, the gain of the left channel is relatively flat from 5,000 to 20,000 Hertz. Below 5,000 Hertz, the gain of the left channel rises to a higher level. Below the range of 1,000 to 5,000 Hertz, capacitor 46 appears to have a significant impedance. As a result, cross-feeding occurs so that when a signal is applied in the left channel, a signal is output from the right channel. The signal out of the right channel is approximately 3 db lower than the signal from the left channel and out-of-phase to enhance images at the side of the observer. Cross-feeding is limited to frequencies below the range of 1,000 to 5,000 Hertz to avoid distortion so that above this range, the gain of the right channel, when a signal is applied to the left channel, drops very quickly. At 10,000 Hertz, the signal from the right channel is 20 db less than the signal from the left channel.

An important aspect of the present invention is that each source of sound providing signals to the channels are treated independently. That is, the present invention does not monitor overall separation between channels and then control cross-feeding accordingly. Thus, if one particular source appears to the side in a predominantly monaural image, when the signal is processed by the present invention, this source will, in fact, appear at the side rather than in the middle with the rest of the monaural sound. This result occurs because the degree of cross-feeding is dependent only upon frequency and not the overall degree of separation.

Although only a single exemplary embodiment of the present invention has been described in detail above, those skilled in the art will readily appreciate that many variations and modifications may be made in the exemplary embodiment without materially departing from the novel features and advantages of this invention. For example, the transfer function of FIG. 2 could be generated by a circuit different from or with additional components to the circuit of FIG. 1.

Accordingly, all such variations and modifications are intended to be included within the scope of the following appended claims.

What is claimed is:

1. An audio signal processing circuit for processing plural channels of related audio signals, said circuit comprising:

a first audio signal processing channel;

a second audio signal processing channel;

cross-feed means for feeding signal levels from the first to second channel and from the second to first channel in an out-of-phase, phase difference relationship with respect to related audio signals already passing through a given channel, said relationship of phase difference versus frequency having not more than one frequency wherein phrase differences for frequencies directly adjacent said one frequency are less than the phase difference at said one frequency; and means for limiting said cross-feeding to components of said signal levels below a predetermined frequency;

said first channel including first means for reversing the phase of low frequency signals with respect to high frequency signals, said first reversing means processing signals before said cross-feed means;

one of said first and second channels including second means for reversing the phase of low frequency signals with respect to high frequency signals, said second reversing means processing signals after said cross-feed means.

2. An audio signal processing circuit as in claim 1 wherein said predetermined frequency is in the range of 1000 to 5000 Hertz.

3. An audio signal processing circuit as in claim 1 wherein said one frequency occurs in the range of 200 to 900 Hertz.

4. A method for enhancing the psychoacoustic image perceived by a listener from a plural channel audio reproduction system, said method comprising the steps of:

first, reversing the phase of low frequency signals with respect to high frequency signals in a first channel;

then, combining a first predetermined relative proportion of audio signals emanating from said first channel with those of a second channel in a first out-of-phase, phase difference relationship;

combining a second predetermined proportion of audio signals emanating from said second channel with those of said first channel in a second out-of-phase, phase difference relationship;

then, reversing the phase of low frequency signals with respect to high frequency signals in one of said first and second channels; and limiting said combining steps to those components of said audio signals below a predetermined frequency;

each of said first and second out-of-phase, phase difference relationships of phase versus frequency having not more than one frequency wherein phase differences for frequencies directly adjacent said one frequency are less than the phase difference at said one frequency.

5. A method as in claim 4 wherein said predetermined frequency is in the range of 1,000 to 5,000 Hertz.

6. A method as in claim 4 wherein said one frequency occurs in the range of 200 to 900 Hertz.

7. An audio signal processing circuit for processing plural channels of related audio signals, said circuit comprising:

a first audio signal processing channel;

a second audio signal processing channel; and cross-feed means for feeding signal levels from said first to second channels and from said second to first channels and combining said cross-fed signal components in an out-of-phase relationship with respect to related audio signals already passing through a given channel;

said first and second channels and said cross-feed means cooperating so that: (1) the overall gain of each of said audio channels in the frequency range of approximately 100 to 1,000 Hertz being greater when a signal is applied to that audio channel only than when the signal is applied to both said first and second channels; and (2) the gain with respect to frequency of each of said audio channels when a signal is applied to both said first and second channels, has a dip in a range of approximately 200 to 900 Hertz;

said first channel including first means for reversing the phase of low frequency signals with respect to high frequency signals, said first reversing means processing signals before said cross-feed means;

one of said first and second channels including second means for reversing the phase of low frequency signals with respect to high frequency signals, said second reversing means processing signals after said cross-feed means.

8. A circuit as in claim 7 wherein said cross-feed means and said first and second channels combine said cross-fed signal components in a phase difference relationship which approaches 180° at approximately 500 Hertz and decreases therefrom as frequency changes away from approximately 500 Hertz.

9. A method for enhancing the psychoacoustic image perceived by a listener from a plural channel audio reproduction system, said method comprising the steps of:

combining a first predetermined relative proportion of audio signals emanating from a first channel with those in a second channel in a first out-of-phase, phase difference relationship;

combining a second predetermined proportion of audio signals emanating from said second channel with those of said first channel in a second out-of-phase, phase difference relationship;

adjusting the overall gain of each of said channels in the frequency range of approximately 100 to 1,000 Hertz so that the gain is greater when a signal is applied to that channel only than when the signals are applied to both said first and second channels;

adjusting the gain of each of said first and second channels, when a signal is applied to both said first and second channels, to have a dip in the range of approximately 200 to 900 Hertz;

reversing the phase of low frequency signals with respect to high frequency signals in one of said channels prior to said combining steps; and reversing the phase of low frequency signals with respect to high frequency signals in one of said channels after said combining steps.

10. A method as in claim 9 wherein said first and second out-of-phase, phase difference relationships cause the phase difference to approach 180° within a range of approximately 200 to 900 Hertz and to decrease as frequency changes from said range.

11. An audio signal processing circuit for processing plural channels of related audio signals, said circuit comprising:

a first audio signal processing channel;

a second audio signal processing channel; and cross-feed means for feeding signal levels from said first to second channels and from said second to first channels and combining said cross-feed signal components in an out-of-phase relationship with respect to related audio signals already passing through a given channel, said cross-feed means limiting cross-feeding to frequency components below a predetermined value;

said first and second channels and said cross-feed means cooperating so that: (1) the overall gain of each of said audio channels in the frequency range of approximately 100 to 1,000 Hertz is greater when a signal is applied to that audio channel only than when the signal is applied to both said first and second channels; and (2) the gain with respect to frequency of each of said audio channels, when a signal is applied to both said first and second channels, has a dip in the range of approximately 200 to 900 Hertz, remains relatively constant at frequencies above said dip and increases gradually at frequencies below said dip; and (3) the gain with respect to frequency of each of said audio channels when a signal is applied to only that channel remains relatively constant at frequencies above 5,000 Hertz at a value less than the gain at frequencies below 1,400 Hertz.

12. A circuit as in claim 11 wherein:

said first audio channel includes first means for reversing the phase of low frequency signals with respect to high frequency signals, said first reversing means processing signals prior to said cross-feed means; and said second channel includes second means for reversing the phase of low frequency signals with respect to high frequency signals, said second reversing means processing signals after said cross-feed means.

13. A circuit as in claim 11 wherein said cross-feed means and said first and second channels combine said cross-fed signal components at a phase difference approaching 180° at approximately 500 Hertz, the phase decreasing as the frequency moves away from approximately 500 Hertz.

14. An audio signal processing circuit for processing plural channels of related audio signals, said circuit comprising:

first means, responsive to one of said audio signals, for reversing the phase of low frequency signals with respect to high frequency signals;

a first audio signal processing channel responsive to said first reversing means;

a second audio signal processing channel responsive to another of said audio signals;

cross-feed means for feeding signal levels from the first to second channels and from the second to first channels and combining the cross-fed signal components in an out-of-phase relationship with respect to related audio signals already passing through a given channel; and second means, responsive to said second audio signal processing channel, for reversing the phase of low frequency signals with respect to high frequency signals.

15. A circuit as in claim 14 further comprising means, coupled to one of said first channel and said second reversing means, for compensating for the difference in gain between said first and second channels caused by the delay induced by said first reversing means in one of said audio signals.

16. A circuit as in claim 14 wherein the gain of said first and second reversing means is constant independent of frequency.

17. A circuit as in claim 16 wherein each of said first and second reversing means comprises:

an amplifier having an inverting input, a noninverting input and an output;

a first resistor connected between said output and said inverting input;

second and third resistors connected in series between an input signal and ground, the junction between said second and third resistors being connected to said inverting input; and a capacitor and a fourth resistor connected in series between said input signal and ground, the junction between said capacitor and said fourth resistor being connected to said noninverting input, said first, second, third and fourth resistors having the same value.

18. A circuit as in claim 14 wherein said cross-feed means and said first and second channels combine said cross-fed signal components in a phase relationship that approaches 180° at approximately 500 Hertz and decreases in phase as the frequency varies away from approximately 500 Hertz.

19. An audio signal processing circuit for processing plural channels of related audio signals, said circuit comprising:

a first amplifying system including first amplifying means with a noninverting input responsive to one of said audio signals, an inverting input and an output, for producing a signal at the output related to the difference of the signals at said inverting and noninverting inputs and a first feedback network coupled between said output and inverting input of said first amplifying means;

a second amplifying system including second amplifying means with a noninverting input responsive to another of said audio signals, an inverting input and an output for producing signals at the second amplifying means output related to the difference of the signals at said second amplifying means inverting and noninverting inputs and a second feedback network coupled between said output and inverting input of said second amplifying means; and a cross-over network coupled between said inverting inputs of said first and second amplifying means;

said first and second amplifying systems and said cross-over network cooperating to cause: (1) the gain of each of said amplifying means in the frequency range of approximately 100 to 1,000 Hertz to be greater when a signal is applied to that amplifying means only than when the signal is applied to both said first and second amplifying means; and (2) the gain with respect to frequency of each of said amplifying means to have a dip in a range of approximately 200 to 900 Hertz when a signal is applied to both said first and second amplifying means.

20. A circuit as in claim 19 wherein said first and second amplifying systems further comprise:

first means, responsive to one of said audio signals, for reversing the phase of low frequency signals with respect to high frequency signals, said first amplifying means being responsive to said first reversing means; and second means, coupled to said output of one of first amplifying means and output of said second amplifying means, for reversing the phase of low frequency signals with respect to high frequency signals.

21. A circuit as in claim 19 wherein said cross-over network and said first and second amplifying means change the phase of signals passing therethrough by an amount approaching 180° at 500 Hertz, the phase change decreasing as the frequency moves away from 500 Hertz.

22. A circuit as in claim 19 wherein each of said first and second feedback networks includes a first resistor, a second resistor and a capacitor, said second resistor and capacitor being interconnected in series and together connected in parallel across said first resistor.

23. A circuit as in claim 22 wherein the inverse of the product of the values of said second resistor and said capacitor is in the range from 14,000 to 20,000 Hertz.

24. A circuit as in claim 19 wherein said cross-over network includes first and second resistors connected in series between said inverting inputs and a capacitor connected between the junction of said first and second resistors and ground.

25. A circuit as in claim 24 wherein the inverse of the product of said capacitor and a parallel combination of said first and second resistors is in the range of 15,000 to 25,000 Hertz.

26. An audio signal processing circuit for processing plural channels of related audio signals, said circuit comprising:

a first amplifying system including first amplifying means with a noninverting input responsive to one of said audio signals, an inverting input and an output, for producing a signal at said output related to the difference of the signals at said inverting and noninverting inputs and a first feedback network coupled between said output and inverting input of said first amplifying means;

a second amplifying system including second amplifying means with a noninverting input responsive to another of said audio signals, an inverting input and an output for producing signals at said second amplifying means output related to the difference of the signals at said second amplifying means inverting and noninverting inputs and a second feedback network coupled between said output and inverting input of said second amplifying means; and a cross-over network coupled between said inverting inputs of said first and second amplifying means, said cross-over network conducting only those components of signals between said amplifying means having frequencies below a predetermined value;

said first and second amplifying systems and said cross-over network cooperating to cause: (1) the gain of each of said amplifying means in the frequency range of approximately 100 to 1,000 Hertz to be greater when a signal is applied to that amplifying means only than when the signal is applied to both said first and second amplifying means; (2) the gain with respect to frequency of each of said amplifying means, when a signal is applied to both said first and second amplifying means, to have a dip at approximately 500 Hertz, to remain relatively level at frequencies above said dip and to increase gradually at frequencies below said dip; and (3) the gain with respect to frequency of each of said amplifying means when a signal is applied to only that amplifying means to remain relatively constant at frequencies above 5,000 Hertz at a level less than the gain at frequencies below 1,400 Hertz.

27. A circuit as in claim 26 wherein said first and second amplifying systems further comprise:

first means responsive to one of said audio signals, for reversing the phase of low frequency signals with respect to high frequency signals, said first amplifying means being responsive to said first reversing means; and second means, coupled to said output of said second amplifying means, for reversing the phase of low frequency signals with respect to high frequency signals.

28. A circuit as in claim 26 wherein said cross-over network and said first and second amplifying means change the phase of signals passing through said cross-over network, said phase change approaching 180° at approximately 500 Hertz and decreasing in phase as frequency moves away from 500 Hertz.

29. A circuit as in claim 26 wherein said first and second feedback networks each comprise first and second resistors and a capacitor, said second resistor and capacitor being interconnected in series and together connected in parallel across said first resistor.

30. A circuit as in claim 29 wherein the inverse of the product of the values of said second resistor and capacitor is in the range of 14,000 to 20,000 Hertz.

31. A circuit as in claim 26 wherein said cross-over network includes first and second resistors connected in series between said inverting inputs and a capacitor connected between the interconnection of said first and second resistors and ground.

32. A circuit as in claim 31 wherein the inverse of the product of the values of said capacitor and said first and second resistors in parallel is in the range of 15,000 to 25,000 Hertz.

33. A circuit as in claim 26 wherein said first and second feedback networks and said cross-over network cooperate to treat the localization of different sound sources independently of each other.

34. An audio signal processing circuit for processing plural channels of related audio signals, said circuit comprising:

first means, responsive to one of said audio signals, for reversing the phase of low frequency signals with respect to high frequency signals;

first amplifier means having a noninverting input coupled to said first reversing means, an inverting input and output;

a first resistance coupled between said output and said inverting input;

a second resistance and a first capacitance interconnected in series and together connected in parallel with said first resistance;

second amplifier means having a noninverting input coupled to another of said audio channels, an inverting input and an output;

a third resistance coupled between said output and said inverting input of said second amplifier means;

a fourth resistance and a second capacitance interconnected in series and together connected in parallel with said third resistance;

fifth and sixth resistance connected in series between said inverting inputs of said first and second amplifier means;

a third capacitance having a terminal connected between said first and sixth resistances, said fifth and sixth resistances and said third capacitance cooperating to prevent signals above a predetermined frequency to pass between said inverting inputs;

second means, coupled to said output of said second amplifier means, for reversing the phase of low frequency signals with respect to high frequency signals; and means coupled to one of said output of said first amplifier means and said second reversing means, for compensating for the difference in gain between said first and second amplifier means caused by the delay induced by said first reversing means in said one of said audio signals;

said first and second reversing means, first and second amplifier means, said first through sixth resistors and said first through third capacitors cooperating to cause: (1) the gain of said one and another audio signals, when said one and another audio signals are the same, to dip at approximately 500 Hertz, to increase gradually at frequencies below said dip and to remain relatively level at frequencies above said dip; and (2) the gain of each of said one and another audio signals, in the frequency range of approximately 100 to 1,000 Hertz to be greater when only a corresponding one of said one and another audio signals are applied than when both said one and another audio signals are the same and applied at the same time.

35. A circuit as in claim 34 wherein each of said first reversing means and second reversing means comprises:

an amplifier having an inverting input, a noninverting input and an output;

a first resistor connected between said amplifier inverting input and said amplifier output;

second and third resistors connected in series between an input signal and ground, said amplifier inverting input being connected to the junction between said second and third resistors; and a capacitor and a fourth resistor connected in series between said input signal and ground, said amplifier noninverting input being connected to the junction between said capacitor and fourth resistor, said first through fourth resistors having the same value.

36. A circuit as in claim 34 wherein the inverse of the product of the values of said second resistor and first capacitor and the inverse of the product of the values of said fourth resistor and second capacitor both are in the range of 14,000 to 20,000 Hertz.

37. A circuit as in claim 34 wherein the inverse of the product of the values of said third capacitor and the parallel combination of said fifth and sixth resistors is in the range of 15,000 to 25,000 Hertz.

38. A method of enhancing the psychoacoustic image perceived by a listener from a plural channel audio reproductive system, said method comprising the steps of:

combining a first predetermined relative proportion of audio signals emanating from a first channel with those of a second channel in a first out-of-phase, phase difference relationship;

combining a second predetermined proportion of audio signals emanating from said second channel with those of said second channel in a second out-of-phase, phase difference relationship;

limiting said combining steps to those components of said audio signals below a predetermined range of frequencies;

adjusting the overall gain of each of said first and second channels in the frequency range of 100 to 1,000 Hertz to increase the gain of a signal applied to that channel only as compared to a signal applied to both said first and second channels;

adjusting the gain of each of said first and second channels when a signal is applied to both said first and second channels so that the gain has a dip in the range of approximately 200 to 900 Hertz, remains relatively constant at frequencies above said dip and increases gradually at frequencies below said dip;

adjusting the gain of each of said channels when a signal is applied to only that channel to remain relatively constant at frequencies above 5,000 Hertz at a value less than the gain at frequencies below 1,400 Hertz;

reversing the phase of low frequency signals in said first channel with respect to high frequency signals before said combining steps; and reversing the phase of low frequency signals in said second channel with respect to high frequency components after said combining steps.

39. A method as in claim 38 wherein said first and second out-of-phase, phase difference relationships cause the phase difference to approach 180° in the range of approximately 200 to 900 Hertz and to gradually decrease as frequency changes away from said range.

40. A method of processing plural channels of related audio signals comprising the steps of:

first reversing the phase of low frequency components of one of said audio signals with respect to high frequency components;

after said first reversing step, feeding signal levels from a first channel receiving the output of said reversing step to a second channel receiving another of said audio signals and from said second channel to said first channel and combining the cross-fed signal components in an out-of-phase, phase difference relationship with respect to related audio signals already passing through a given channel; and after said feeding step, reversing the phase of low frequency components of signals from said second channel with respect to high frequency components.

41. A method as in claim 40 further comprising the step of compensating for the difference in gain between said first and second channels caused by the delay induced by said reversing step performed prior to said cross-feeding step.

42. A method as in claim 40 wherein during said reversing steps, gain is maintained constant independent of frequency.

43. A method as in claim 40 wherein said out-of-phase, phase difference relationship causes the phase difference to approach 180° in a range of approximately 200 to 900 Hertz and to decrease gradually as frequency changes away from said range.

* * * * *